US007859948B2

(12) United States Patent
Plomb

(10) Patent No.: US 7,859,948 B2
(45) Date of Patent: Dec. 28, 2010

(54) WATCH WITH AT LEAST ONE THREE-DIMENSIONAL TIME INDICATOR

(76) Inventor: Vincent Plomb, Rue de Stade 1, Boncourt (CH) CH-2926

( * ) Notice: Subject to any disclaimer, the term of this patent is extended or adjusted under 35 U.S.C. 154(b) by 285 days.

(21) Appl. No.: 12/281,231

(22) PCT Filed: Feb. 28, 2007

(86) PCT No.: PCT/EP2007/051921

§ 371 (c)(1),
(2), (4) Date: Aug. 29, 2008

(87) PCT Pub. No.: WO2007/099134

PCT Pub. Date: Sep. 7, 2007

(65) Prior Publication Data

US 2009/0046539 A1 Feb. 19, 2009

(30) Foreign Application Priority Data

Mar. 1, 2006 (CH) ..... 0322/06

(51) Int. Cl.
*G04B 19/26* (2006.01)
*G04B 19/00* (2006.01)
*G04B 25/00* (2006.01)

(52) U.S. Cl. ..... 368/16; 368/76; 368/223

(58) Field of Classification Search ..... 368/15–19, 368/76, 80, 88, 223, 276, 281, 299
See application file for complete search history.

(56) References Cited

U.S. PATENT DOCUMENTS

| | | | | |
|---|---|---|---|---|
| 3,665,700 | A | 5/1972 | Ditello et al. | 58/57 |
| 3,766,727 | A | 10/1973 | Didik | |

FOREIGN PATENT DOCUMENTS

| | | | |
|---|---|---|---|
| CH | 666 380 | | 7/1988 |
| CH | 684 814 | A | 1/1995 |
| DE | 39 18 647 | A1 | 2/1991 |
| EP | 0 566 529 | A1 | 10/1993 |
| FR | 2 112 010 | A | 6/1972 |
| FR | 2 679 052 | A1 | 1/1993 |
| JP | 63 052088 | A | 3/1988 |
| JP | 63 128284 | | 5/1988 |
| WO | WO 91/11756 | A | 8/1991 |

OTHER PUBLICATIONS

International Search Report dated Aug. 29, 2007, issued in corresponding international application No. PCT/EP2007/051921.
Written Opinion in French issued in corresponding international application No. PCT/EP2007/051921.

*Primary Examiner*—Vit W Miska
(74) *Attorney, Agent, or Firm*—Ostrolenk Faber LLP

(57) ABSTRACT

The invention relates to a watch provided with time indicators with three dimensions placed at the periphery of the movement of the watch, in the space delimited by the middle, the glass, the base and the movement. The movement of these indicators is provided by various clockwork mechanisms that are either independent or connected to the principle movement.

20 Claims, 10 Drawing Sheets

Coupe D-D

Coupe C-C

Coupe A-A

Coupe B-B

WATCH WITH AT LEAST ONE THREE-DIMENSIONAL TIME INDICATOR

CROSS REFERENCE TO RELATED APPLICATIONS

The present application is a 35 U.S.C. §371 National Phase conversion of PCT/EP2007/051921, filed Feb. 28, 2007, which claims benefit of Swiss Application No. CH00322/06, filed Mar. 1, 2006, the disclosure of which is incorporated herein by reference. The PCT International Application was published in the French language.

TECHNICAL FIELD

The present invention relates to a watch provided with three-dimensional principal or complementary time indicators that are placed at the periphery of the movement in the space delimited by the middle, the glass, the back, and the movement. The mobility of these indicators may be provided by various kinematics that will be described below. They can also be decorated as it is a tradition in clockmaking. The watch described in the present invention has the advantage and the effect of increasing the readability of the indicators, on one hand, by the fact that they are three-dimensional, and by the displacement of the complementary time indications to the periphery of the dial, on the other hand. Thus, the invention relates to an improvement of the readability both of the indicators and functions that are displaced and of those that are not. To allow a peripheral positioning of the indicators, it is necessary to create a space in the case by increasing the interior dimensions of the middle with respect to the external dimensions of the dial at the location of one of these indicators. This space may have the shape of a crown segment, of a crescent, of a slot applied to the dial or another, more complex shape that is better described by a graphic representation. The space may also involve the entire contour of the dial in a regular or irregular shape. The principal time indicators are the hour, minute, and second indicators. The complementary indicators are the different calendar days, the power reserve, the time zones, striking works having one or multiple hammers, an appearance, e.g. of a cuckoo or of another symbol, the indication of the moon phases, the lunar calendar and the lunation calendar, the course of the sun in the sky, a day/night indication, the representation of the earth illuminated by the sun, an operation indicator, a dynamograph, a chronograph, a week indicator, mysterious calendars, and different cycles relating to time, more particular ludic cycles. The complementary indicators may be designed as additional modules of the watch movement. Alternatively, they may be integrated therein. The mechanisms which actuate the indicators or the functions and may or may not be connected to the movement allow their movement, more particularly a rotational or translational movement with respect to marks that are suitably placed to be visible.

PRIOR ART

The prior art includes different references that are cited below. Swiss Patent Application CH 666 380 G describes a watch comprising a decorative disc with a shaped cutout that is freely rotatable above the movement as well as a second movable element having a peripheral crescent-shaped portion provided with brilliants that creates an imbalance and is freely rotatable on the same axis as the first decorative disc, which corresponds to the axis of the hands. This assembly has a purely decorative function with the particularity of an aleatory animation of its two movable elements as a result of the movement of the watch wearer's arm.

U.S. Pat. No. 3,665,700 depicts a watch with a case provided with an extension in the form of a housing in which a longilineal balance is visible. This balance is mechanically connected to the escapement, which transmits a movement to the balance that indicates its operation. The description also points out the ornamental effect of the invention. The problem raised by this patent is in the operation of the device. In fact, the principle of a balance clock of the pendulum type requires the latter to be placed in a vertical position in order to operate correctly.

European Patent EP0566529 describes a device for displaying the phases of the moon and a watch provided with such a device. The representation of the moon in three dimensions is located in the interior of the case and driven by kinematics that allow it to turn around the dial in a lunation while turning once around itself. The important difference with respect to this patent is that in the present invention, the moon, which also turns around itself once in a lunation, is stationary in the space that is provided therefor at the periphery of the dial and does not turn around the latter.

International Patent Application WO9111756 shows a device for displaying the moon, more particularly below the dial of a watch. The device comprises a circular support set into rotation by a driving mechanism mounted in the watch housing, and carrying a replica of the moon which moves with the support along a window formed in the watch dial. With respect to the previously cited patent, this patent application claims a mechanism that makes the moon turn around the dial once in a day. The support represents the sky and comprises a window that indicates the position of the moon between the time it rises and the time it sets. Here, the same remark as for the preceding patent applies, i.e. the mechanism of the moon occupies the entire periphery of the dial, thereby making it impossible to arrange other three-dimensional counters or functions on the latter.

SUMMARY OF THE INVENTION

The invention described herein allows a large variety of applications which distinguish themselves by the type of the indicator or visible function that is provided, by the utilized mechanism and its integration with the movement, by its representation, and by the selected position at the periphery of the dial. One aspect of the invention is the fact that the third dimension (Z axis) is used for accommodating indicators or functions at the periphery of the dial which are visible in particular from the top of the watch and are autonomous or are coupled to the movement and actuated by the latter.

It is an object of the present invention to suggest a watch that is free from the limitations of the devices of the prior art and in particular to suggest a watch with time indicators having a three-dimensional appearance that can be coupled to the movement or provided in the form of additional modules.

BRIEF DESCRIPTION OF THE FIGURES

The particular embodiment of the invention that has been chosen without limiting the latter in any way is a watch comprising an indicator of the moon phase, of the course of the sun as a retrograde function, and the representation of the earth illuminated by the sun, all three indicators being three-dimensional. This embodiment will be described hereinafter with reference to the following figures.

EXEMPLARY EMBODIMENTS OF THE INVENTION

Figure 1:
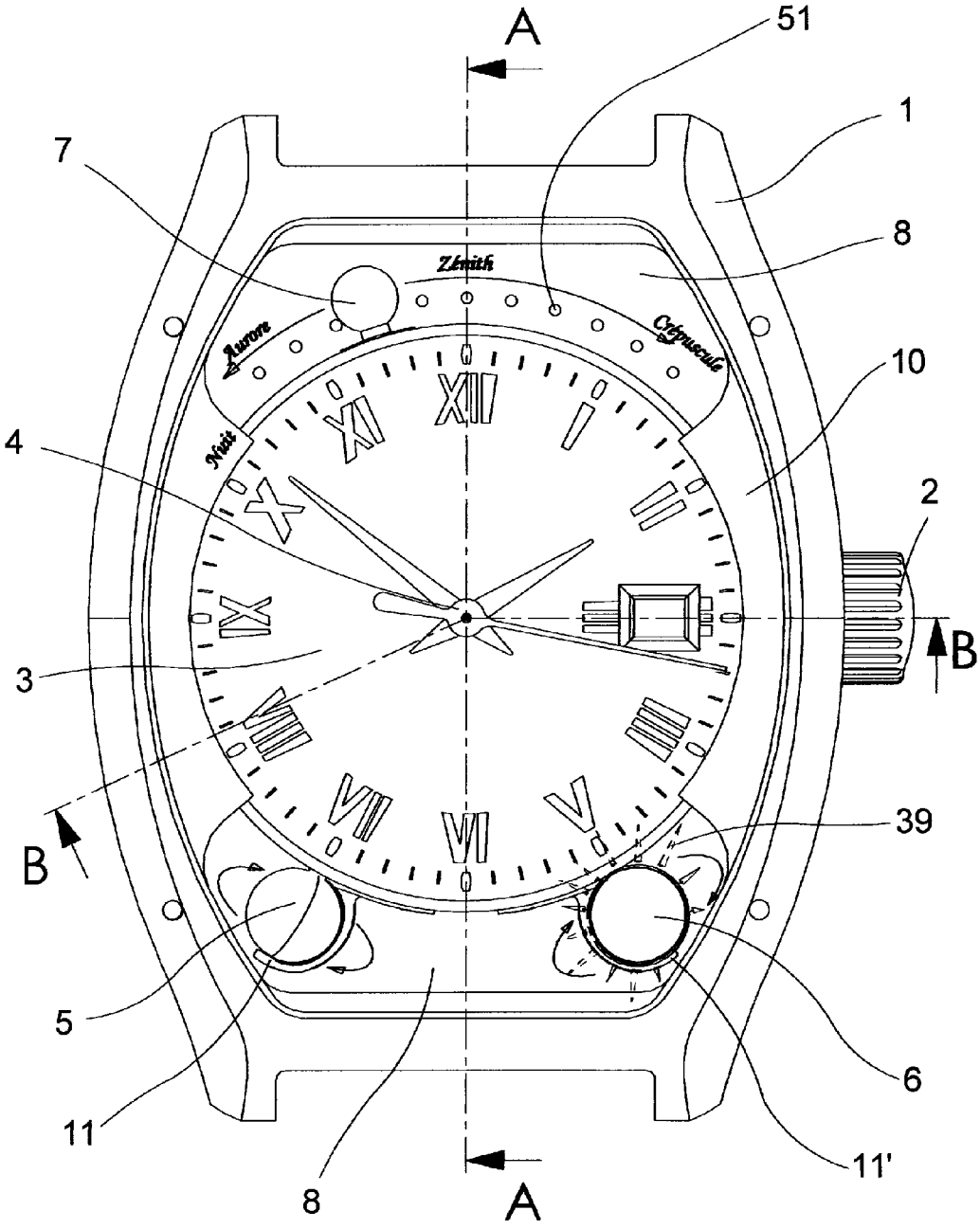
FIG. 1: Top view of the watch.

FIG. 1 is a top view of the watch. The usual elements of the casing are illustrated, in particular: middle 1, crown 2, dial 3, and hands 4. Three-dimensional moon 5 is part of the moon phase indicator. A bright half and a dark half move according to the rotation transmitted thereto by a mechanism that will be described below. A support 11, in which the outer bearing is arranged, as well as an inner bearing 46 that is visible in FIG. 7, ensure the necessary rigidity in that the sphere of the moon is supported at both ends of its axis. The same principle is used for the indicator of the earth 6 illuminated by the sun. The operation of its mechanism is as follows: earth 6 is represented by a sphere on which the five continents are depicted. The sun is represented by rays 39 or marks whose imaginary center corresponds to the zenith with respect to the earth, which is located at the center of the indicator. The continent that is located on the longitude passing through the imaginary center of the sun indicates that the latter is at its zenith on this fictional line. The inner surface of back 8 is visible in the background of these two indicators. It may be provided with marks or symbols. The course of the sun 7 is preferably located on the exterior of the 10*h* to 2*h* portion of the dial. The sun is represented by a sphere 7 that moves in the clockwise direction in the course of the day. Its daily course is equal to twelve hours. This indicator also serves as a day/night indicator. The function of the retrograde sun is set at the same time as the hands of the watch, the beginning and the end of the sun's course being set to six o'clock a.m. and six o'clock p.m. The mechanism may further comprise an integrated device for reducing or increasing the duration of the sun's course according to the latitude. It is also possible to realize a mechanism for an automatic correction of sunrise and sundown to follow the seasonal variations. The latter mechanism would preferably be accommodated in an independent housing. It could also comprise a dial indicating the hour of sunrise and sundown. Likewise it is intended to integrate a counter or a countdown of the number of solar cycles indicating e.g. the number of days to a deadline or the number of remaining vacation days. This indicator has a retrograde function, i.e. at the end of its daily course, sun 7 turns back and enters into a receptacle 12, see FIG. 3, where it is hidden during the twelve hours of the night. The course of the sun is above the inner surface of back 8, which may be provided with marks or symbols. Flanges 10 are solid portions of the middle that extend up to the dial. They may be provided with cutouts or refined in function of the esthetic requirements. In this embodiment, they allow hiding the attachments of the movement to the middle. They may also be used for separating the indicators from one another.

Figure 2:
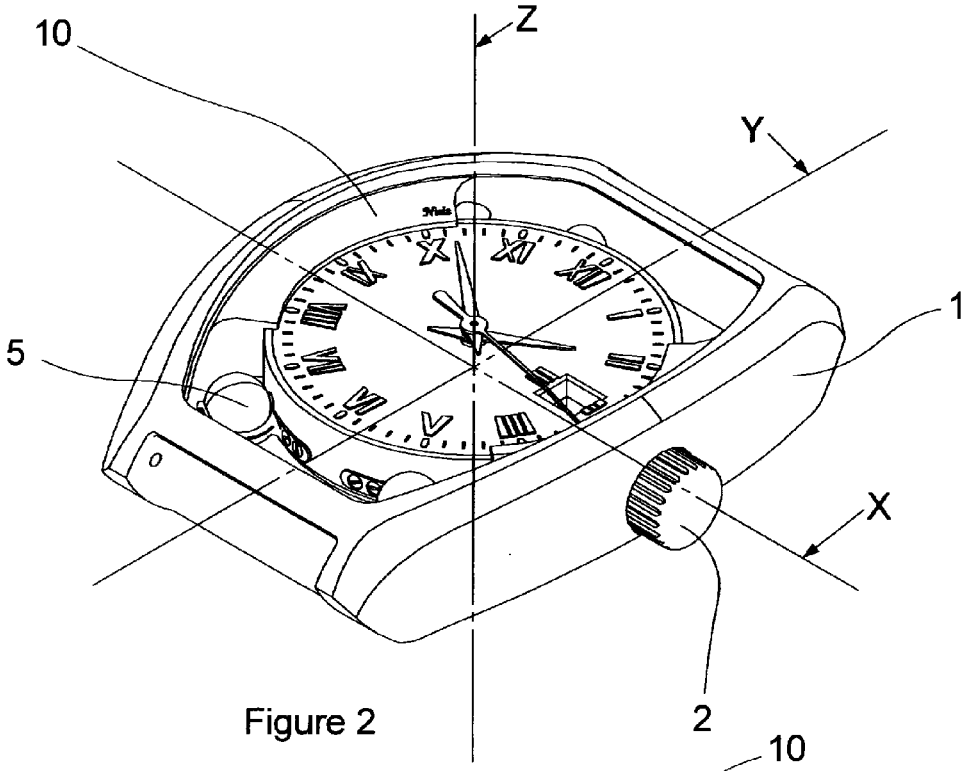
FIG. 2: Isometric 3D front ¾ view of the watch.

FIG. 2 is an isometric three-dimensional front ¾ view of the watch. The three orthogonal axes X, Y, Z are depicted to facilitate the description. The benefit of this view and of the following view is that they show the utilization of space, more particularly of the depth (Z axis) for the travel of the indicators described in this embodiment. The indicator of the moon phases 5 is clearly visible in this view.

Figure 3:
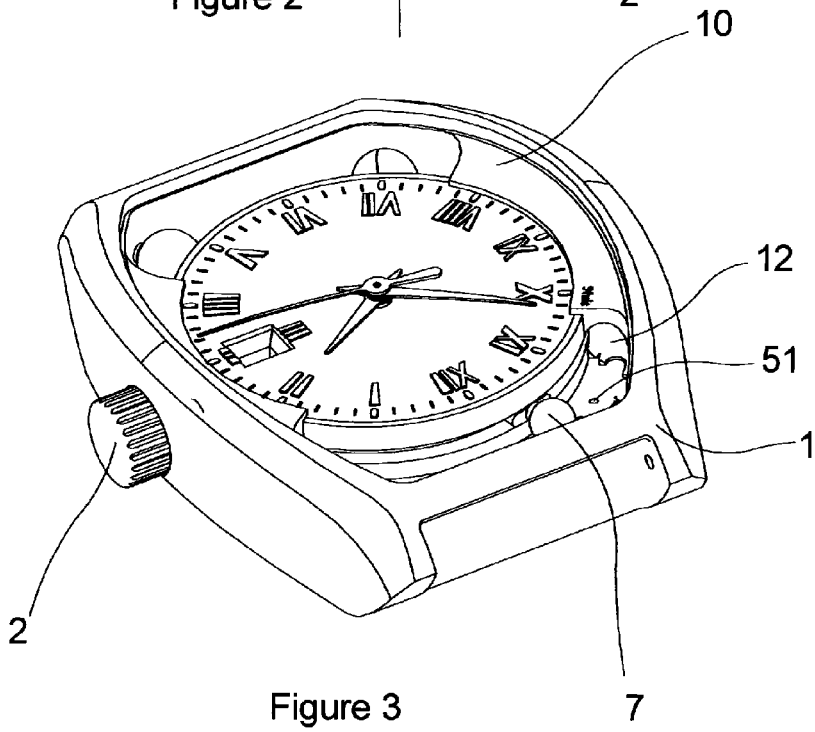
FIG. 3: Isometric 3D rear ¾ view of the watch.

FIG. 3 is a view that is similar to the preceding one, however in the rear ¾ position. In this view, the retrograde sun is visible, as well as its receptacle 12 for the night position.

Figure 4:
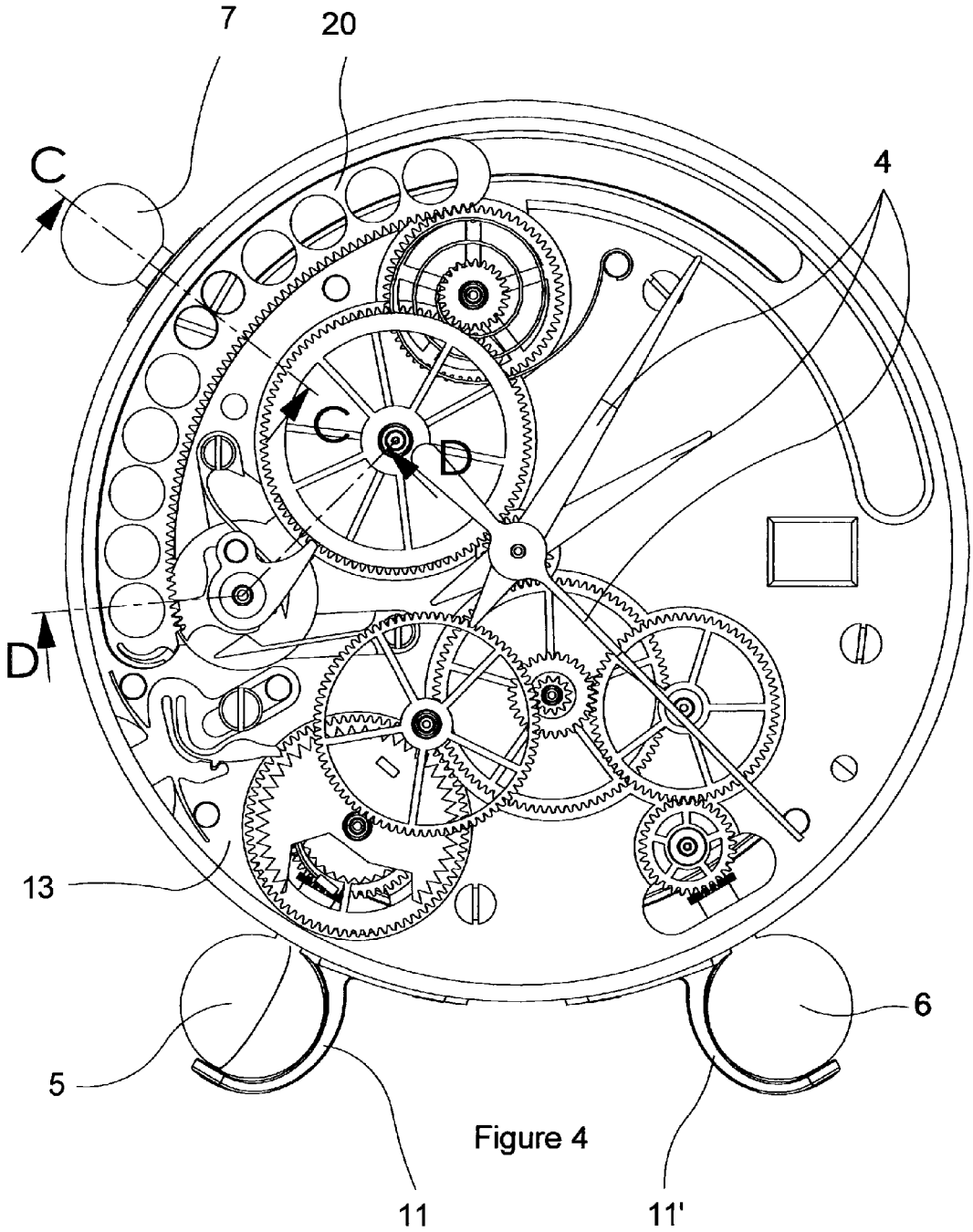
FIG. 4: View of the elements of the movement that are affected by the described indicators.
Figure 8:
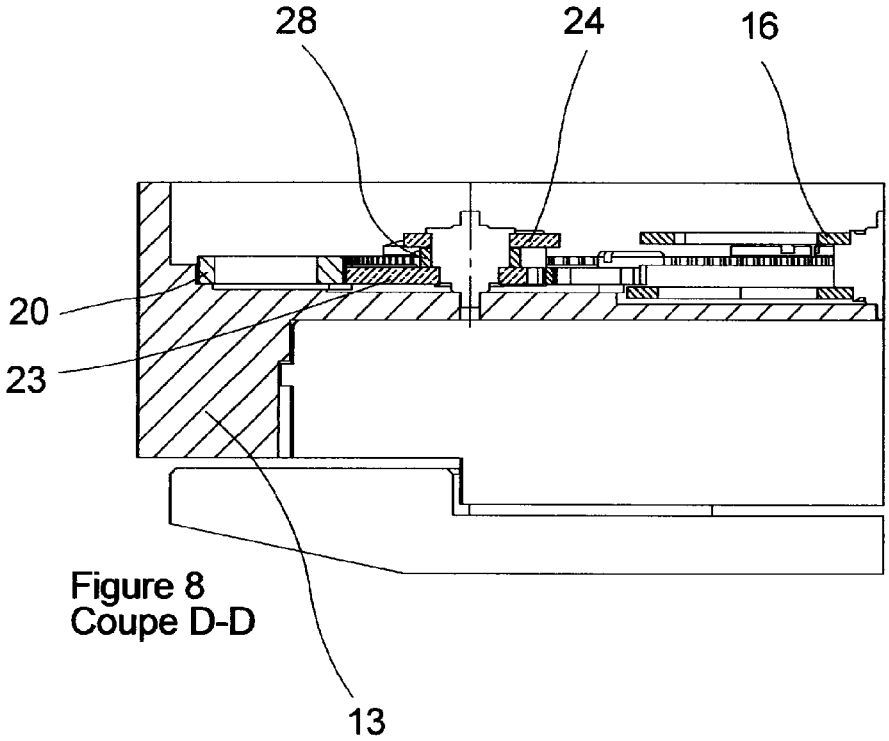
FIG. 8: Section D-D of the mechanism for locking the sun in the night position.

FIG. 4 is a general view of the mechanisms for animating the indicators. Except for hands 4, which are used as reference marks, all elements shown here are related to the operation of the indicators. The positions of sections C-C, FIG. 9, and D-D, FIG. 8, are also visible.

Figure 5:
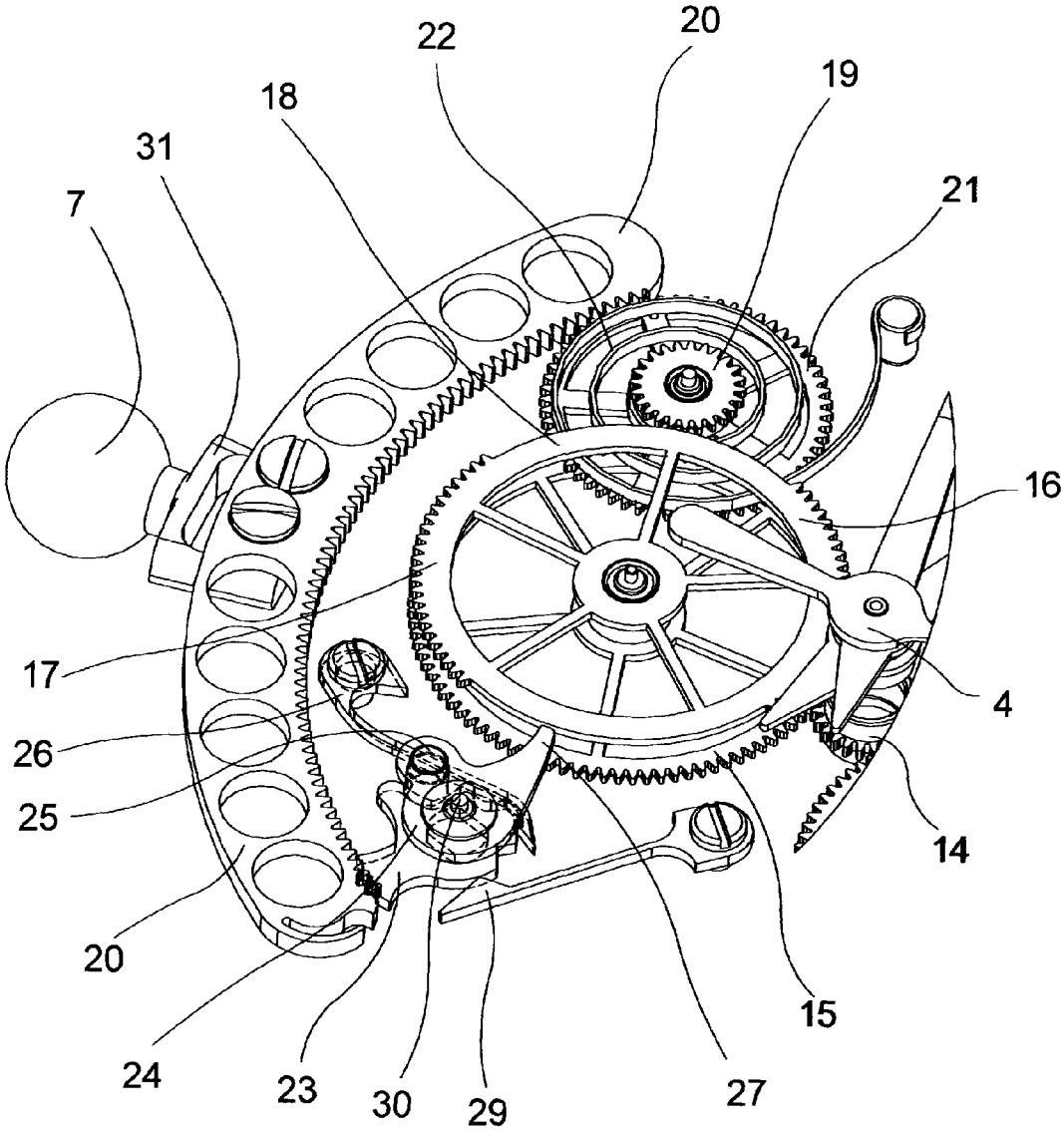
FIG. 5: Detail of the mechanism of the retrograde sun indicator in the night position.

FIG. 5 describes the details of the mechanism of the retrograde sun indicator in the night position. A wheel 14 is fixed to the tube on which hands 4 are mounted. It drives a large wheel 15 that is connected to a second wheel 16 mounted on the same axle in a higher position. This second wheel 16 is divided into four segments: two opposite toothed segments 17 and two other, untoothed ones 18. The toothed segments 17 drive pinion 19 of the adjacent mobile during the day, whereas untoothed segments 18 liberate the same pinion 19, which corresponds to the night position. One turn of wheel 16 corresponds to two days and two nights. In a lower position on the axle of pinion 19, toothed wheel 21 is mounted which drives curved and toothed rack 20 to which sun 7 is attached by means of support 31. If required for the safety of the mechanism, an imbalance compensation may be realized by a second rack 20' (not shown in the drawing) that is arranged underneath or above the first one and moves in the inverse direction due to the fact that it is meshing with an intermediate wheel 52 arranged between this second rack 20' and adjacent toothed wheel 21, which may be provided with a shock absorber. A spiral return spring 22 is disposed between pinion 19 and wheel 21. It is tensioned during the displacement of rack 20, respectively of second rack 20' in the diurnal course of the sun and released when the untoothed segment 18 of wheel 16 liberates pinion 19. The force of return spring 22 allows returning rack 20, respectively second rack 20', and sun 7 to the starting position, i.e. the night position. A safety for locking sun 7 in the night position is arranged between wheel 16 and rack 20. This safety device, suggested by way of example, is composed of a lower cam 23 that is fixed on axle 30 and meshing with rack 20 when it returns to the night position. The device further comprises an upper cam 24 and a spacer 28 arranged between the two cams, see FIG. 8, the two parts being mounted on axle 30 in a freely rotatable manner. Upper cam 24 is provided with a post 25 that may enter into contact with lower cam 23, and with a lever 27 that is actuated by toothing 17 of wheel 16 at the beginning of the day phase and liberated at the beginning of the night phase. A pawl spring 26 is in contact with lower cam 23 and pin 25 of upper cam 24. A jumper spring 29 presses on another part of lower cam 23. Its role is to maintain this cam in the day position. The night position lock is achieved as follows: when rack 20 is returned to the night position by the action of return spring 22 upon wheel 21, the first teeth of rack 20 mesh with the toothed portion of lower cam 23, which is held in place by pawl spring 26. This pressure of spring 26 is possible due to the fact that cam 23 is positioned so as to receive pawl spring 26 under the action of the return of rack 20. Cam 23, which is provided with a nose (visible in dotted lines in the Figure) repositions cam 24 via post 25. Since lever 27 of cam 24 is not in contact with toothed segment 17, this disposition allows pawl spring 26 to hook cam 23.

Figure 6:
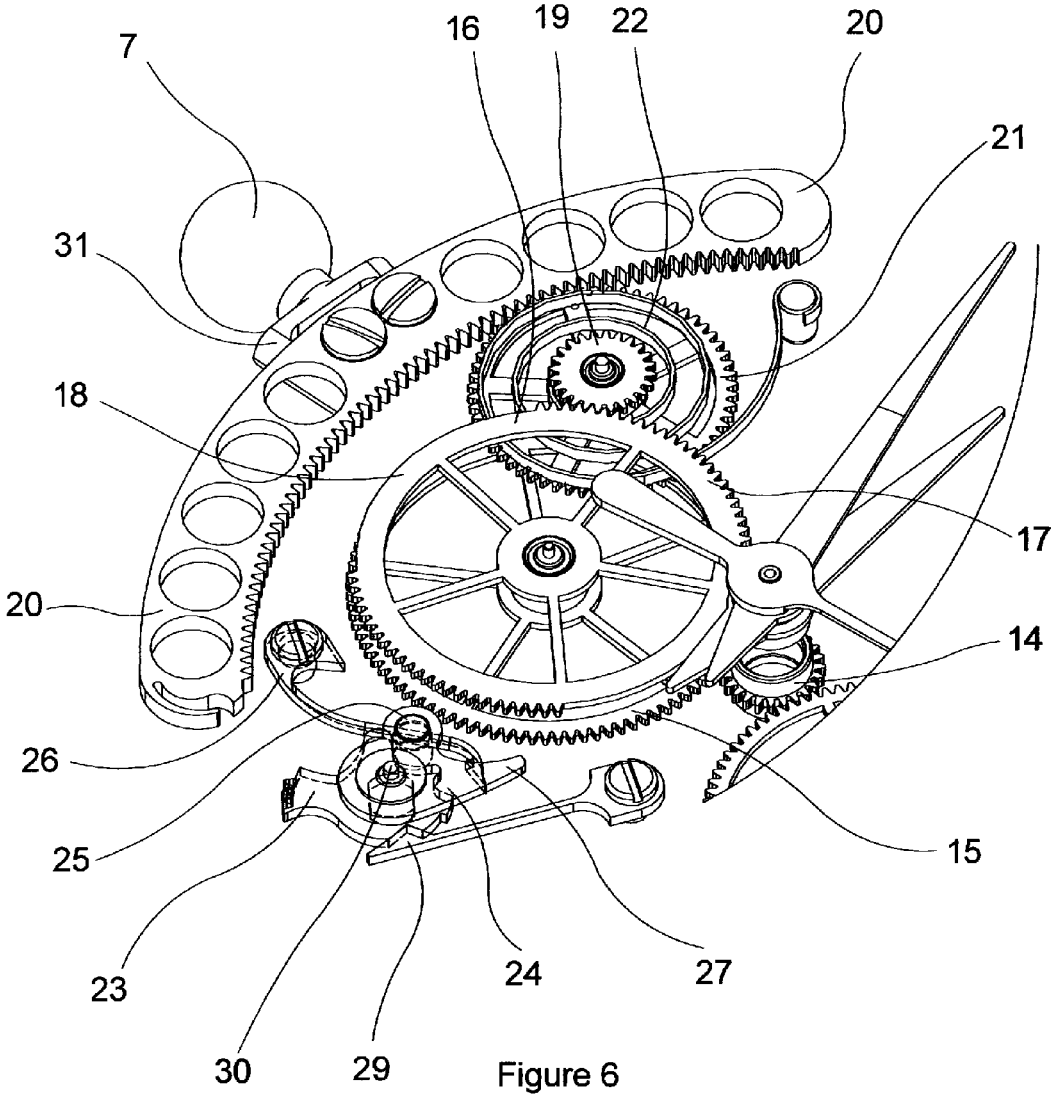
FIG. 6: Detail of the mechanism of the retrograde sun indicator in the day position.

FIG. 6 describes the operation of the mechanism of the retrograde sun indicator in the day position in more detail. The engagement of the mechanism takes place when the toothing of toothed segment 17 of wheel 16 enters into contact with lever 27 of the locking device, approximately one tooth space before opposite toothed segment 17 of wheel 16 enters into contact with pinion 19. During this movement, lever 27 removes pawl spring 26 from lower cam 23 by means of post 25, thereby liberating rack 20 and allowing its displacement. When the last tooth of rack 20 has released lower cam 23, the engagement of jumper spring 29 in a suitable notch brings the lower cam into the position for receiving rack 20 for the night, thereby again engaging the locking function described in the preceding figure. In this position, by means of post 25, lower cam 23 keeps upper cam 24 out of contact with toothed segment 17 of wheel 16.

Figure 7:
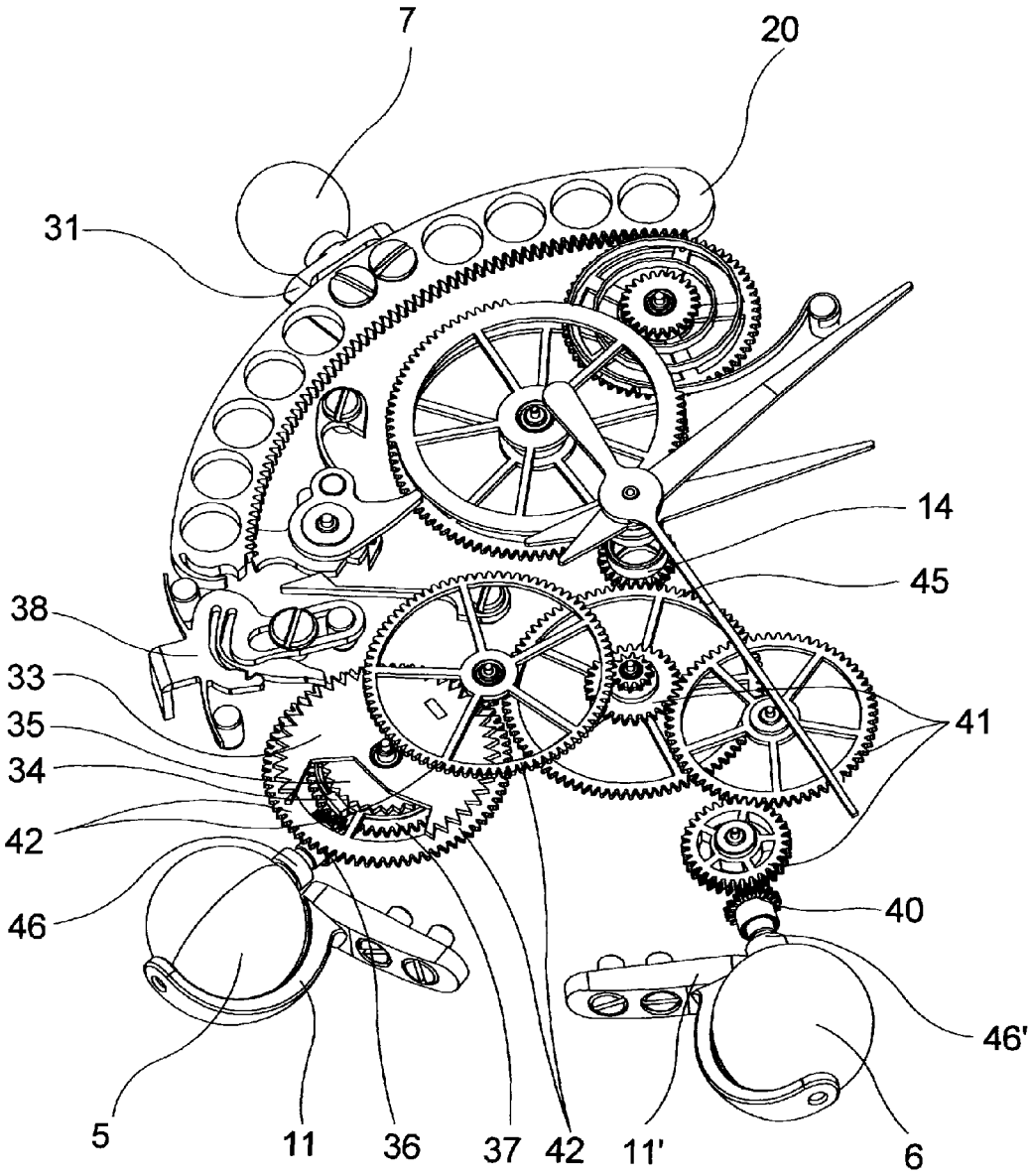
FIG. 7: Exploded view of the elements that are affected by the described indicators.

FIG. 7 shows a general view of the elements of the movement, more particularly of the mechanisms for actuating moon 5 and earth 6. Sun 7 and its support 31 attached to rack 20 are easily recognizable. The mechanism for animating moon 5 is composed of a wheel train that starts from wheel 14, which is also used by the retrograde sun mechanism. Wheel 14 is meshing with toothed wheel 45 that is in turn coupled to gear train 42, the latter being connected to wheel 37. With regard to FIG. 7, gear train 42 ( ) may comprise an additional wheel for inverting the direction of rotation of the moon. Wheel 37 is meshing with pinion 36, which drives the axle of moon 5. The latter is supported by two bearings, an inner bearing 46 and an outer bearing accommodated in its support 11. Furthermore, on this wheel train, the device for correcting the position of the moon is mounted which is composed of corrector 38 that acts upon correction wheel 33, of star wheel 35, and of suitable leaf springs 34 for indexing the latter. This correction device is known in the art and hence need not be described in more detail. A more precise indication of the position of the moon is realized by a lunar calendar comprising twenty-nine days that is coupled to pinion 36. Earth 6 is set into rotation by the same wheels 14 and 45 as the moon and then by gear train 41, of which the last wheel engages pinion 40 which drives the axle of earth 6. The latter is supported by two bearings, as for the moon, namely an inner bearing 46' and an outer bearing accommodated in its support 11'. A corrector of the same type as that used for the moon (not shown in FIG. 7) allows adjusting the position of the earth with respect to the time zones or the continents. A more precise indication of the earth can be realized by integrating a counter that indicates the momentary time zone that corresponds to the zenith of the sun.

According to this aspect of the invention, the axes of rotation relating to the rotation of earth 6 and moon 5 are stationary in the sense that they maintain a fixed position with respect to the watch and to dial 3. More particularly, in the example illustrated in FIG. 1, the axis of moon 5 is located at 7 o'clock while the axis of earth 6 is located at 5 o'clock, relative to dial 3. Moon 5 and earth 6 always stay in position at 7 o'clock and 5 o'clock, respectively, while being set into rotation by the corresponding gear trains.

FIG. 8 is a section D-D of the mechanism for locking the retrograde sun in the night position. The section line is visible in FIG. 4. The parts are mounted on the mainplate of movement 13. Curved and toothed rack 20 is meshing with lower cam 23. On the same axle, spacer 28 and upper cam 24 are visible. Adjacent thereto and at the same height, wheel 16 with toothed and untoothed segments is arranged. The two parts are not in contact with each other in this night position phase.

Figure 9:
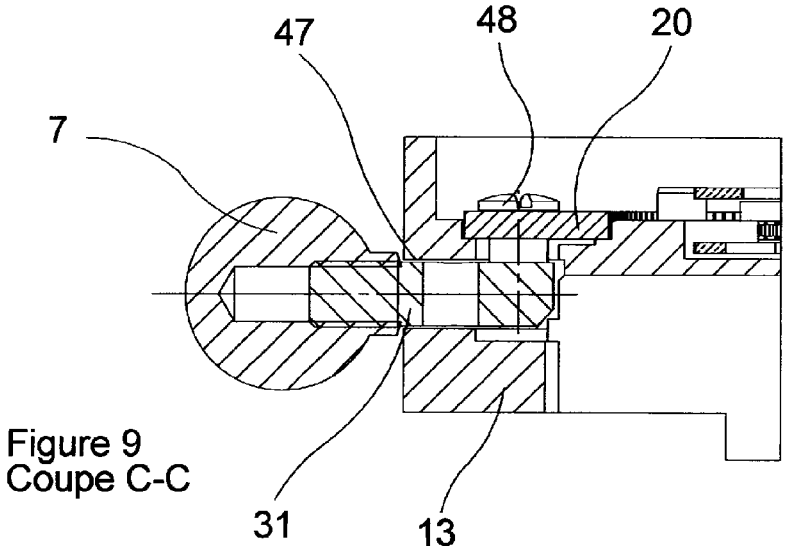
FIG. 9: Section C-C of the retrograde sun indicator and of the rack.

FIG. 9 is a section C-C of the retrograde sun indicator and of the rack. The section line is visible in FIG. 4. Sun 7 is screwed to a support 31 that is affixed to rack 20 by two screws 48 of which one is visible in the figure. Recess 47 made in the mainplate of movement 13 allows the passage of support 31 during the displacement of sun 7.

Figure 10:
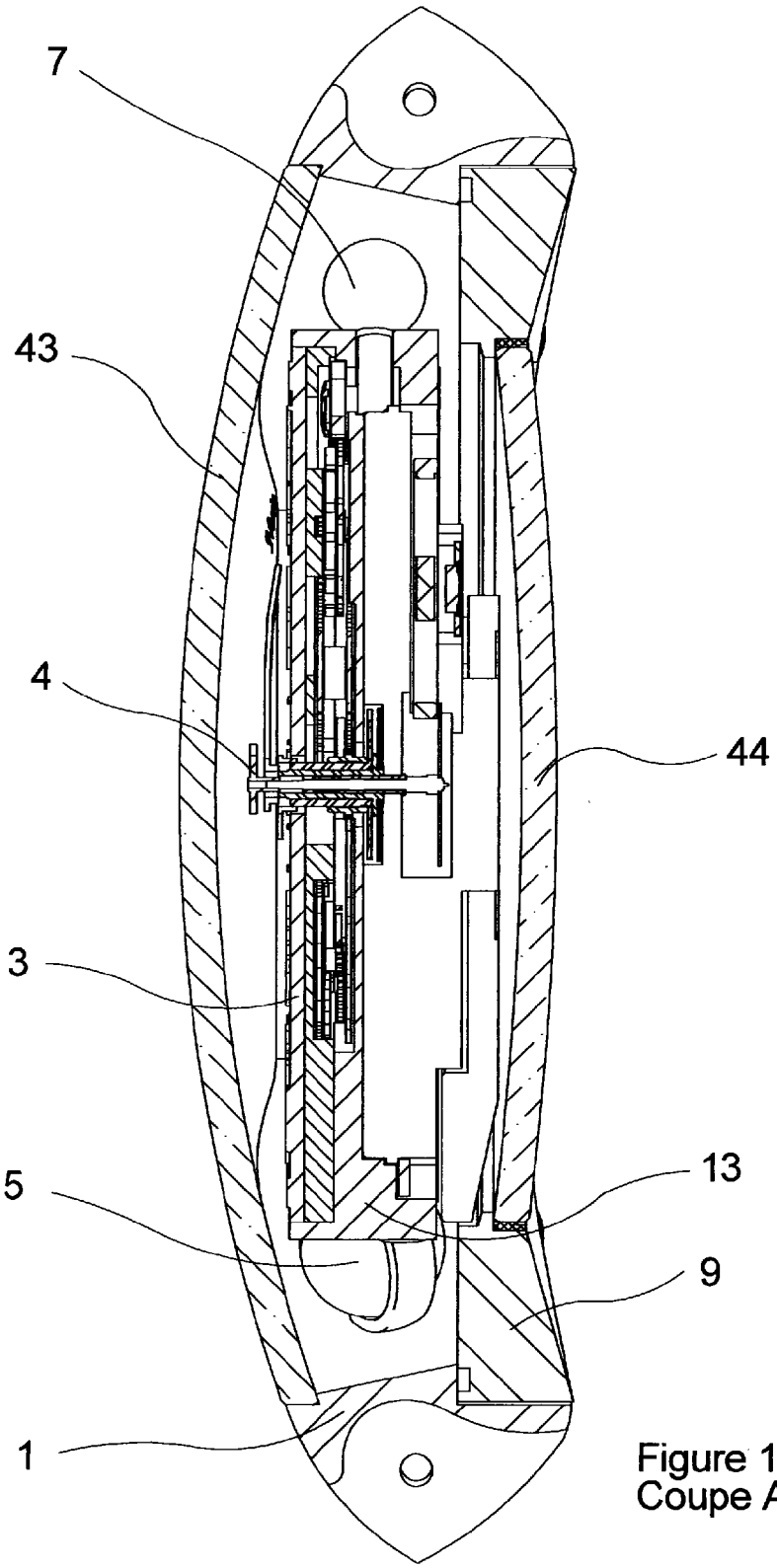
FIG. 10: Section A-A of the watch.

FIG. 10 is a **6*h*-12*h* section of the watch. This sectional view is of interest in that it shows a part of the space in which retrograde sun 7 and moon 5 move. The earth is not visible in the drawing. The section shows movement 13 with dial 3 and hands 4 placed in middle 1. The space is closed by glass 43 and, below the watch, by back 9, which is also provided with a glass 44**.

In this embodiment of the invention, the watch includes a peripheral space inside the case in which the complementary indicators are arranged, e.g. indicators representing celestial bodies such as the moon, the sun, or the earth in three dimensions, or indicators in two dimensions. The peripheral space is delimited by movement 13, middle 1, glass 43, and back 9, and is at least partially visible through glass 43. The complementary indicators are thus located outside dial 3.

Figure 11:
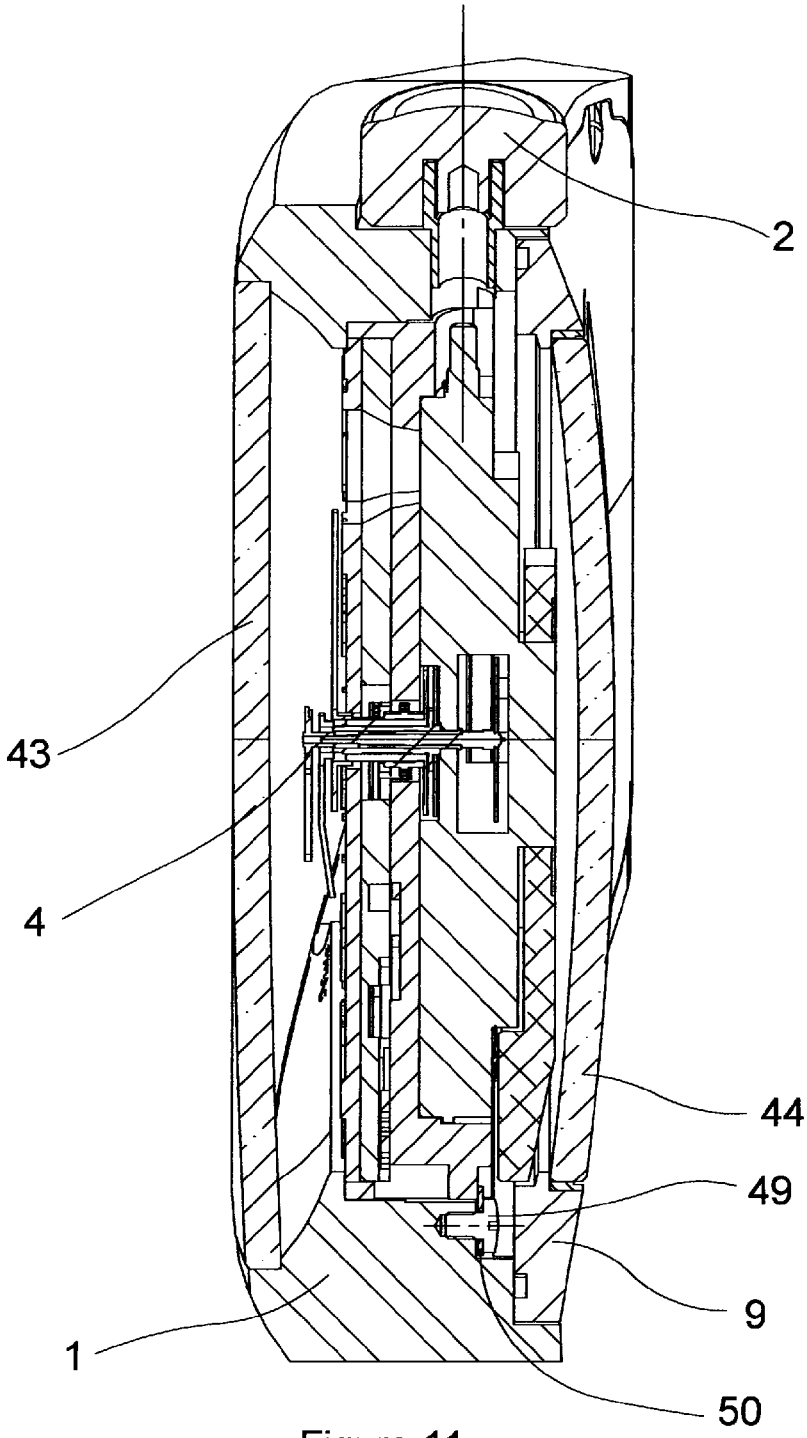
FIG. 11: Section B-B of the watch.

FIG. 11 shows section B-B. The section line is visible in FIG. 1. This sectional view shows one way of mounting movement 13 inside middle 1 by means of mounting lugs 50 that are maintained by screws 49. In this example, middle 1 is milled out of a solid piece and allows mounting movement 13 directly. Alternatively, in other embodiments, intermediate parts such as cages or rings may also be used. Further visible in this figure are glass 43, back 9, glass of back 44, and crown 2.

Figure 12:
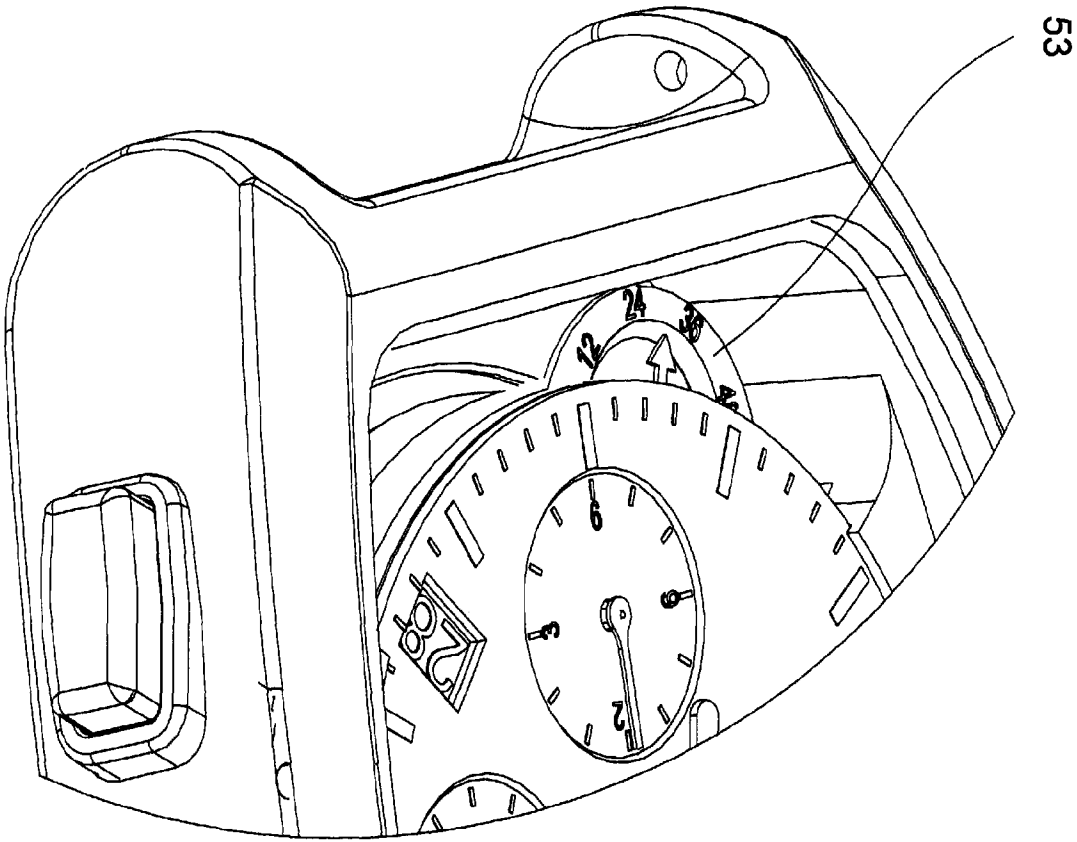
FIG. 12: View of the 2D indicator arranged at the periphery of the watch.

FIG. 12 shows a 2D indicator arranged in the previously described space. Here, the third dimension (the z axis) is used to allow a vertical and axial offset of an indicator that is relatively large in relation to the available space, thereby allowing a partial but sufficient display of this indicator. Here, the marks are arranged on a disk. In this configuration, the hand may be fixed and the disk movable or vice versa.

The embodiment described above demonstrates the feasibility of the invention and the possibility of extending it to other indicators, in particular the principal indicators showing the hour, the minute, or the second, or other functions such as enumerated above.

What is claimed is:

1. Watch provided with time indicating members, the watch having at least one peripheral space that is radially delimited by a movement and a middle, and at least one element that is able to travel in this space owing to a mechanism that may cooperate with the movement and thus to provide at least one additional indication that is represented by a symbol, wherein the at least one peripheral space and the at least one element comprise at least one space with a three-dimensional element of the retrograde type and at least one space with a two- or three-dimensional element of a type that is stationary and rotatable about its axis, the dimensions of each space being adapted to the respective type of element.

2. Watch according to claim 1, wherein actuating means allow the element and its corresponding symbolical information to move from an apparent position to a position in which it is hidden in an initial receptacle.

3. Watch according to claim 2, wherein the actuating means comprise a toothed rack to which the element is connected, the rack having the shape of a circular crown that is coupled to a wheel via a mobile, the wheel being fixed to an hour pipe of the time indicating members and meshing with a wheel that is connected to a coaxial wheel, and in that this wheel cooperates with a wheel that is connected to a coaxial wheel meshing with the toothing of the rack, the wheel alternatingly comprising on its periphery at least one toothed circular segment and at least one untoothed circular segment such that the element moves in its space where it is visible or is maintained in the receptacle depending on whether the wheel is meshing with the toothed segment or positioned in front of the untoothed segment of the wheel.

4. Watch according to claim 3, wherein an elastic member is arranged between the wheels and so as to be tensioned when the wheel is driven by the toothed segment and causes the element to move and is released when the wheel is liberated by the untoothed segment, the restoring force of the elastic member returning the element to its receptacle.

5. Watch according to claim 3, wherein the wheels make one turn in 48 hours, and in that the wheel has a succession of two segments which are preferably equal to one another, such that the element is moving in its space during a diurnal period of 12 hours whereas it remains motionless during a nocturnal period of 12 hours.

6. Watch according to claim 3, wherein a locking and unlocking device that is advantageously arranged between the wheel and the rack allows to maintain the rack and the element supported thereon in its initial position during the nocturnal period and to release it therefrom at the start of the diurnal period.

7. Watch according to claim 6, wherein the locking and unlocking device comprises dual cams one of which is provided with a toothing that is capable of engaging with and being disengaged from the toothing of the rack under the combined action of elastic members, and the other one of which has a lever that is capable of cooperating with the wheel.

8. Watch according to claim 3, wherein the mechanism for the actuation of the element comprises a balancing device that is advantageously formed of a second rack which is equivalent to the rack and arranged underneath or above the rack, this second rack meshing with a reversing mobile such that the movements of the racks are inverted and allow a compensation of the imbalance in the case of a shock.

9. Watch according to claim 1, wherein the space in which the element moves reveals a back that may be provided with any desired representation, and in that this space advantageously extends between ten o'clock and two o'clock.

10. Watch according to any one of claims 1, wherein the retrograde element is separated on either side of a stationary element by a flange formed of a solid portion of the middle that extends up to a dial and may be used for any chosen functional or esthetic indication.

11. Watch according to any one of claims 1, wherein the element represents the sun.

12. Watch according to claim 1, wherein the element, which rotates around an axis of revolution and is supported by an assembly of a support and bearings, is coupled to a wheel via a gear train, the wheel meshing with a pinion arranged in the axis of the element and to which it is coupled, in that the wheel is fixed to an hour pipe of the time indicating members and makes one turn in 12 hours, and in that the gear train is so designed that the element turns once around itself during a defined period, the latter advantageously corresponding to one lunation approximately.

13. Watch according to claim 12, wherein the gear train cooperates with a device for correcting the defined period.

14. Watch according to claim 12, wherein the gear train may be completed by an reversing wheel for inverting the direction of rotation of the element.

15. Watch according to claim 12, wherein the peripheral space in which the rotating element moves is arranged at 7 o'clock.

16. Watch according to any one of claims 12, wherein the rotating element represents the moon.

17. Watch according to claim 1, wherein the element, which rotates around an axis of revolution and is supported by an assembly of a support (11') and bearings (46'), is coupled to a wheel via a gear train, the wheel meshing with a pinion arranged in the axis of the element and to which it is coupled, in that the wheel is fixed to an hour pipe of the time indicating members and makes one turn in 12 hours, and in that the gear train is so designed that the element turns once around itself during a defined period, the latter advantageously corresponding to 24 hours.

18. Watch according to claim 17, wherein the gear train cooperates with a corrector device for the defined period.

19. Watch according to claim 17, wherein the peripheral space in which the rotating element moves is arranged at 5 o'clock.

20. Watch according to claim 17, wherein the rotating element represents the earth.

* * * * *